United States Patent [19]

Barclay et al.

[11] 4,417,955

[45] * Nov. 29, 1983

[54] METHOD OF AND SOLUTION FOR ELECTROPLATING CHROMIUM AND CHROMIUM ALLOYS AND METHOD OF MAKING THE SOLUTION

[75] Inventors: Donald J. Barclay, Olivers Battery; William M. Morgan, Chandlers Ford, both of England

[73] Assignee: International Business Machines Corporation, Armonk, N.Y.

[ * ] Notice: The portion of the term of this patent subsequent to Feb. 27, 1996 has been disclaimed.

[21] Appl. No.: 421,635

[22] Filed: Sep. 22, 1982

Related U.S. Application Data

[63] Continuation of Ser. No. 913,639, Jun. 8, 1978, abandoned, which is a continuation-in-part of Ser. No. 833,634, Sep. 15, 1977, abandoned, which is a continuation-in-part of Ser. No. 637,483, Dec. 3, 1975, Pat. No. 4,062,737.

[30] Foreign Application Priority Data

Jan. 26, 1977 [GB] United Kingdom ..... 3179/77

[51] Int. Cl.[3] ..... C25D 3/06; C25D 3/56

[52] U.S. Cl. ..... 204/43 R; 204/43 T; 204/51

[58] Field of Search ..... 204/51, 43 T, 43 R

[56] References Cited

U.S. PATENT DOCUMENTS 2,088,615 8/1937 Schlotter ..... 204/51

2,822,326 2/1958 Safranek ..... 204/43

*Primary Examiner*—G. L. Kaplan

*Attorney, Agent, or Firm*—Francis A. Sirr

[57] ABSTRACT

A plating solution and method of forming such a solution for plating chromium and its alloys from Cr(III) is disclosed. The solution is an aqueous solution of a chromium(III) thiocyanate complex having at least a ligand other than water or thiocyanate in the inner coordination sphere.

18 Claims, No Drawings

METHOD OF AND SOLUTION FOR ELECTROPLATING CHROMIUM AND CHROMIUM ALLOYS AND METHOD OF MAKING THE SOLUTION

This is a continuation of application Ser. No. 913,639, filed June 8, 1978 and now abandoned, which in turn was a continuation-in-part of application Ser. No. 833,634, filed Sept. 15, 1977 and now abandoned which in turn was a continuation-in-part of application Ser. No. 637,483, filed Dec. 3, 1975 and now U.S. Pat. No. 4,062,737.

BACKGROUND OF THE INVENTION

The present invention relates to the electroplating of chromium and its alloys.

Commercially, chromium has been plated from aqueous chromic acid baths prepared from chromic oxide ($CrO_3$) and sulphuric acid. Such baths in which the chromium is in hexavalent form present a considerable health hazard as a result of the emission of chromic acid fumes. In addition, the baths are highly corrosive and it has proved difficult to plate chromium alloys.

The above-entitled application Ser. No. 637,483 describes and claims a chromium or chromium alloy electroplating solution in which the source of chromium comprises an aqueous solution of a chromium(III) thiocyanate complex. The specification further describes a process of plating chromium or a chromium containing alloy comprising passing a current between an anode and a cathode in said electroplating solution. In a preferred form, the chromium(III) thiocyanate complex consists of an aqueous solution of an aquo chromium(III) thiocyanate complex or mixture of complexes having the general formula:

$$((H_2O)_{6-n}Cr^{III}(NCS)_n)^{3-n}, \text{ where}$$

n=a positive integer from one to six.

Note that subscripts are always positive or zero, but superscripts may be positive, negative or zero. Complexes of this type are well-known. Chromium(III) species in solution are generally octahedral with six ligands coordinated to the chromium atom. These ligands occupy and define the inner coordination sphere of the chromium atom and are inert inasmuch as they exchange very slowly with free ligands in the solution; e.g., the exchange reaction:

$$(Cr(H_2O)_5(NCS))^{+2} + {}^*(NCS)^- \rightarrow (Cr(H_2O)_5{}^*(NCS))^{+2} + (NCS)^-$$

is very slow (the * represents a "tagged" ion). It is the slowness of reactions of this type which complicates the chemistry of chromium(III) and necessitates equilibration of solutions at high temperatures. See the book by Basolo and Pearson entitled, *Mechanism of Inorganic Reactions: Study of Metal Complexes in Solution,* published by Wiley.

The linear thiocyanate anion $NCS^-$ has unique catalytic properties; it is able to coordinate surfaces to metal ions through its nitrogen atom and to metal surfaces through its sulphur atoms; and its electron density is extensively localized across the three atoms.

The thiocyanate anion is believed to catalyze the electron transfer reaction:

$$Cr(III) + 3e^- Cr(O)$$

through the formation of multiple-ligand bridges between a thiocyanate Cr(III) complex and the surface of the cathode. The electro-active intermediate can be identified as:

Cr(III)-NCS-M where M is the metal surface of the cathode which is Cr(O) after an initial monolayer of chromium is plated. The "hard" nitrogen coordinates to the Cr(III) ion and the "soft" sulphur to the metal surface of the cathode. Multiple-ligand bridging by thiocyanate in the electrochemical oxidation of chromium(II) at mercury electrodes is described in Inorganic Chemistry 9, 1024 (1970).

Said application Ser. No. 833,635, entitled "Method and Composition for Electrolating Chromium and its Alloys and the Method of Manufacture of the Composition," describes and claims a chromium or chromium alloy electroplating solution in which the source of chromium comprises an aqueous solution of a chromium(III) thiocyanate complex, the ratio in the solution of total chromium(III), i.e., both free and complexed, to total thiocyanate, i.e., both free and complexed, being 1:6. It should be noted that with a chromium to thiocyanate ratio of 1:6 in the electrolyte, the equilibrated mixture with contain chromium(III) thiocyanate species with less than six thiocyanates coordinated to the chromium. For example, if the hexathiocyanatochromate(III) anion $(Cr(NCS)_6)^{3-}$ is equilibrated at high temperatures, the predominate chromium solution species will be $(Cr(H_2O)_5(NCS))^{+2}$ and $(Cr(H_2O)_4(NCS)_2)^+$. The same result can be achieved by heating a 1:6 mixture of $(Cr(H_2O)_6)^{3+}$ and NaNCS. These above applications further describe a process of plating chromium or a chromium containing alloy comprising passing a current between an anode and a cathode in such a solution.

The chromium(III) thiocyanate complex plating solutions described in the above-mentioned applications do not produce the serious health hazard present during plating by the conventional chromic acid bath and, additionally, they do produce an effluent that is easier and safer to dispose of. These plating solutions have many other advantages, including low material cost, greater electrical efficiency and very low corrosion of capital equipment. The deposited chromium is microcrack free and is capable of being bent without cracking. Further, it has proved possible to plate alloys of chromium by incorporating metal salts in the solution.

The presence of chromium and thiocyanate in the solution in the ratio 1:6 permits the chromium(III) thiocyanate complex to be prepared by equilibrating a commercially available hexathiocyanatochromate(III) salt. This also has the advantage that the concentration of the ion $(Cr(H_2O)_6)^{3+}$ in the plating solution is maintained at a low level. The presence of $(Cr(H_2O)_6)^{3+}$ is thought to produce black nonmetallic deposits at low current densities.

Plating chromium from an organic solution containing thiocyanatopentaamine chromium(III) complexes, i.e., $(Cr^{III}(NH_3)_5(NCS))^{+2}$, has been suggested by Levy and Momyer in an article in *Plating,* November 1970, pp. 1125–1131. However, in this article, the authors state that no deposition was possible using an aqueous solution.

An article in the *Journal of Electrochemical Society*, "Electrochemical Science," October 1971, Volume 118, No. 10, pp. 1563–1570, by Levy and Momyer describes the deposition of chromium from hexaminechromium(III) formate, i.e., $Cr^{III}(NH_3)_6(HCO_2)_3$ in an organic solvent (acetamide/formamide which is not a thiocyanate complex). In this article, Levy and Momyer state with reference to the plating bath comprising an organic solvent containing thiocyanatopentaamine chromium(III) disclosed in their 1970 article referenced above that "the baths were unstable during prolonged electrolysis" (page 1564, column 1). Also in the 1971 article, Levy and Momyer suggest the addition of small amounts of thiocyanate to form aquothiocyanatoamine chromium(III) complexes to overcome the effect of water present as an impurity (400 ppm) in the organic solvent. Clearly, there is no suggestion that chromium could be plated from aqueous solutions in the above-referenced articles by Levy and Momyer.

Chromium has been plated from chromium chloride ($CrCl_3.6H_2O$) contained in dipolar aprotic solvent (such as dimethylformamide) and water (see U.K. Patent specification No. 1,144,913). The ability to use chromium chloride has been desired for many years because it is a readily available, cheap, trivalent salt.

However, such solutions possess limitations which hindered their industrial acceptance. In particular, parts of complex shapes could not be plated satisfactorily and the poor electrical conductivity of the solution due to the presence of the dipolar aprotic solvent required a power supply capable of supplying up to twenty volts. Reduction in the quantity of the dipolar solvent resulted in an unstable bath. In addition, the solution was relatively expensive. The plating solution also contained between 0.5 and 1.5 M chromium ions (a relatively high concentration). Also, there are health hazards associated with the use of dipolar solvents, e.g., dimethylformamide. Thus, these solutions have not been commercially successful.

U.S. Pat. No. 3,917,517, claiming priority from United Kingdom Patent Application No. 47424/73, describes a chromium or chromium alloy electroplating solution comprising chromic chloride or sulphate having hypophosphite ions as a supplement to or replacement of the dipolar aprotic solvent.

German Offenlegungsschift Nos. 2612443 and 2612444, claiming priority from United Kingdom Patent Applications Nos. 12774/75 and 12776/76, respectively, describe an aqueous solution comprising chromic sulphate having hypophosphite or glycine ions as "weak complexing agents." In addition, the solutions described in these patents require chloride or fluoride ions, respectively.

United Kingdom Patent specifications Nos. 1,455,580 and 1,455,841 describe another approach that has been used to deposit chromium from aqueous solutions of trivalent salts. In these patents, the source of chromium ions was chromic chloride, sulphate or fluoride. In addition, bromide ions, ammonium ions, and formate or acetate ions are stated to be essential.

However, none of the patent specifications describe the use of thiocyanate with its unique catalytic properties.

SUMMARY OF THE INVENTION

The present invention provides a source of chromium for an electroplating solution comprising an aqueous solution of a chromium(III) thiocyanate having at least one ligand other than thiocyanate or water in the inner coordination sphere of the complex.

The present invention also provides a chromium or a chromium alloy electroplating solution in which the source of chromium comprises an aqueous solution of a chromium(III) thiocyanate complex having at least one ligand other than thiocyanate or water in the inner coordination sphere of the complex.

The present invention further provides a process for plating chromium or a chromium containing alloy comprising passing an electric plating current between an anode and a cathode in a plating solution having a source of chromium comprising an aqueous solution of a chromium(III) thiocyanate complex having at least one ligand other than thiocyanate or water in the inner coordination sphere of the complex.

DESCRIPTION OF THE PRESENT INVENTION

According to the present invention, complexes for electroplating are provided which are mixed chromium(III) aquothiocyanato complexes having at least one ligand other than thiocyanate or water in the inner coordination sphere. This can be expressed by the general formula:

$$((H_2O)_xCr^{III}L_y(NCS)_z)$$

where x is 0 or a positive integer and y and z are each positive integers, the sum of x, y and z not exceeding 6; and where L is said other ligand which is preferably selected from $CL^-$, $Br^-$, $SO_4^{-2}$, $PO_4^{-3}$ and $NO_3^{-1}$. However, other anions may be employed.

Quite unexpectedly, it has been found possible to deposit chromium from these chromium(III) thiocyanate complexes having at least one ligand other than thiocyanate or water in the inner coordination sphere using the catalytic Properties of thiocyanate ion. Further, it has been found possible to prepare these complexes by equilibrating Cr(III) with said other ligand and thiocyanate ions.

Particularly advantageous complexes are mixed chromium(III) thiocyanate complexes having the formula:

$$((H_2O)_{6-m-n}Cr^{III}Cl_m(NCS)_n)^{3-m-n}$$

where both m and n are positive integers and the sum of m+n does not exceed six.

These complexes have several very significant advantages, such as the elimination of perchlorate ions present in the chromium(III) thiocyanate baths described in the above-mentioned patent applications, the ability to use highly conductive chloride salts in the electrolyte, and the availability of a wider range of pH (2.0 to 4.0) for plating. It appears that the $Cl^-$ ion stabilizes chromium(III) against hydrolysis and also that the black deposits caused by the presence of $(Cr(H_2O)_6)^{3+}$ are minimized. Thus, it will be appreciated by those skilled in electroplating art that the deposition of chromium as a result of the present invention is much simplified and is now comparable with normal, single metal deposition processes, e.g., for nickel or copper.

The chromium(III) chlorothiocyanate complexes can be prepared by equilibrating an aqueous solution of chromium(III) thiocyanate with a chloride salt, such as NaCl or KCl. Alternatively, the chromium(III) chlorothiocyanate complexes can be prepared by equilibrating an aqueous solution of chromium chloride ($CrCl_3.6H_2O$) with sodium thiocyanate.

Similarly, chromium(III) bromothiocyanate, chromium(III) sulphatothiocyanate, chromium(III) phosphatothiocyanate, chromium(III) nitratothiocyanate complexes, etc., can be prepared by equilibrating an aqueous solution of the appropriate chromium(III) salt with sodium or potassium thiocyanate as described above.

The chromium(III) sulphatothiocyanate complexes can be prepared by equilibrating an aqueous solution of chromium(III) thiocyanate with a sulphate, such as $Na_2SO_4$, $K_2SO_4$ or $(NH_4)_2SO_4$. Alternatively, the chromium(III) sulphatothiocyanate complexes can be prepared by equilibrating an aqueous solution of chromium sulphate ($Cr_2(SO_4)_3.15H_2O$) with sodium or potassium thiocyanate. Mixed chromium(III) thiocyanate complexes prepared in this way can be described by the general formula:

$$((H_2O)_{6-2m-n}Cr(III)(SO_4)_m(NCS)_n)^{3-2m-n}$$

where m is 1 or 2 and n is an integer of at least 1 and where 2M=n does not exceed 6.

The use of chromic sulphate as the starting material for preparing the chromium(III) thiocyanate complexes is particularly significant since it is the cheapest and most readily available of the trivalent chromium salts.

The plating of chromium-containing alloys is now made possible by the use of chromium(III); previously no alloy plating appeared to be possible from hexavalent chromium solutions. Furthermore, chromium-nickel, chromium-cobalt, and iron-cobalt-chromium alloys can be plated by the addition of nickel sulphate ($NiSO_4.6H_2O$) or cobalt sulphate ($CoSO_4.7H_2O$) or ferrous sulphate ($FeSO_4.7H_2O$), for example, to a chromium(III) chlorothiocyanate complex solution.

The invention will now be described with reference to the following examples.

EXAMPLE I

In the preparation of a plating solution according to the invention, a 0.05 M aqueous solution of chromic chloride ($CrCl_3.6H_2O$) was prepared. This solution was saturated with 50 g/liter of boric acid ($H_2BO_3$) and then equilibrated at 80° C. for one hour with 0.1 M sodium thiocyanate (NaNCS) and 1.5 M sodium chloride (NaCl). Sodium chloride improves the conductivity of the solution. The equilibrated solution was cooled, its pH adjusted to 3.0 by the addition of dilute sodium hydroxide solution, and 1 g/liter sodium lauryl sulphate (a wetting agent) was added.

A plating process according to the invention and employing the plating solution as prepared above was carried out as follows.

The plating solution was introduced into a Hull cell having a flat platinized titanium anode and a flat surfaced brass cathode. No ion exchange membrane was used to separate the anode and cathode. A plating current of three amps was passed for two minutes. Bright chromium was found to be deposited over a range of current densities from 10 mA/cm$^2$ to 150 mA/cm$^2$.

EXAMPLES II & III

Preparation of a plating solution according to the invention was carried out as in Example I, except that the pH of the solution was adjusted to 3.5 and 2.5, respectively, by the addition of dilute sodium hydroxide solution. The plating process as described in Example I produced a bright chromium deposite at both pH values.

EXAMPLE IV

Preparation of a plating solution according to the invention was carried out as in Example I, except that 1.5 M potassium chloride (KCl) was used instead of the sodium chloride and 0.1 M potassium thiocyanate (KNCS) was used instead of the sodium thiocyanate. The plating process as described in Example I produced a bright chromium deposit.

EXAMPLES V & VI

Preparation of a plating solution according to the invention was carried out as in Example I, except that the wetting agent FC-98 (product of the 3 M Corporation) and the wetting agent TRITON-X (TRITON is a trademark of Rohm and Haas Company) were used, respectively, instead of the wetting agent sodium lauryl sulphate. The plating process as described in Example I produced a bright chromium deposit with both the wetting agent FC-98 and the agent TRITON-X over the current density range 10 mA/cm$^2$ to 150 mA/cm$^2$.

EXAMPLE VII

Preparation of a plating solution according to the invention comprised preparing an aqueous solution of aquochromium(III) thiocyanate as described in Example I of our above-mentioned U.S. Pat. No. 4,062,737, entitled "Method and Composition for Electroplating Chromium and its Alloys and the Method of Manufacture of the Composition," the ratio of chromium(III) to thiocyanate being 1:6. The chromium(III) aquothiocyanate complex aqueous solution was saturated with boric acid ($H_3BO_3$) and equilibrated with 2 M solution of sodium chloride at 80° C. for one hour. The plating process as described in Example I produced a bright chromium deposit. The deposit was obtained over a current density range of 5 mA/cm$^2$ to 200 mA/cm$^2$. Also, it was found that bright chromium deposits could be obtained over a range of pH between 2.0 and 4.0.

EXAMPLE VIII

Preparation of a plating solution according to the invention was as described in Example VII, except that the aqueous solution of the chromium(III) aquothiocyanate complex had a 1:2 ratio chromium(III) to thiocyanate. The plating process as described in Example I produced a bright chromium deposit.

EXAMPLE IX

A process according to the invention employing a plating solution was prepared as described in Example I to produce a chromium deposit two microns thick on a polished brass strip. The chromium deposit was bright and crack free. (Chromium deposits over 0.5 microns thick normally have cracked surfaces.)

EXAMPLE X

A plating solution according to the invention prepared as in Example I was made 0.2 M in NI(II) by the addition of 47.4 g/liter $NiCl_2.6H_2O$. Nickel to chromium alloys of various compositions were deposited from this solution.

EXAMPLE XI

A mixed chromium(III) thiocyanate complex according to the invention was prepared in solution as in Example I, but with bromide anions rather than chloride anions.

Hence, a 0.05 M solution of chromic bromide ($CrBr_3.6H_2O$) was saturated with boric acid ($H_3BO_3$) and then equilibrated at 80° C. for one or two hours with 0.1 M sodium thiocyanate (NaNCS) and 1 M sodium or 1 M potassium bromide (NaBr or KBr).

A bath from which chromium was electrodeposited was prepared by adjusting the pH of this solution to between 2.5 and 3 with dilute sodium hydroxide solution and adding a wetting agent, for example, 1 g/liter of sodium lauryl sulphate.

EXAMPLE XII

A mixed chromium(III) thiocyanate complex according to the invention was prepared in solution as in Example I, but with sulphate anions rather than chloride anions.

Hence, a 0.05 M solution of chromic sulphate ($Cr_2(SO_4)_3 15H_2O$) was saturated with boric acid ($H_3BO_3$) and then equilibrated at 80° C. for one to two hours with 0.1 M sodium thiocyanate NaNCS) and 1 M sodium sulphate ($Na_2SO_4$).

A bath from which chromium was electrodeposited was prepared by adjusting the pH of this solution to between 2.3 and 3 with dilute sodium hydroxide solution and adding a wetting agent, 1 g/liter of sodium lauryl sulphate.

EXAMPLE XIII

Preparation of a plating solution according to the invention was carried out as in Example I, except that 1.5 M ammonium chloride was used instead of the sodium chloride to improve the conductivity of the solution. The plating process as described in Example I produced a bright chromium deposit.

EXAMPLE XIV

A mixed chromium(III) thiocyanate complex according to the invention may be prepared as in Example XI, except that the ratio of chromium(III) to thiocyanate ions is 1:4. The constituents given are per liter of plating bath.

Dissolve 50 grams of boric acid and 160 grams of sodium sulphate ($Na_2SO_4.10H_2O$) in 1 liter deionised or distilled water. Adjust pH to 2.5 with 10% NaOH or 10% $H_2SO_4$. Add 33 grams chromium(III) sulphate ($Cr_2(SO_4)_3.15H_2O$) and 32 grams sodium thiocyanate (NaNCS). When the salts are dissolved, heat the solution to 85° C.±5° C. and maintain at this temperature for ninety minutes. Cool; adjust the pH to 2.5 with 10% NaOH or 10% $H_2SO_4$. Add 0.5 gm/liter sodium lauryl sulphate. This solution is now ready for plating.

A satisfactory plating current is 50 mA/cm$^2$ which deposits 0.5 $\mu$m bright chromium in six minutes. Carbon anodes or platinized titanium anodes may be used, but carbon anodes are preferred. Temperature should be maintained in the range of 20°–25° C. during plating. Bright chromiun is deposited over the range 8 mA/cm$^2$ to 220 mA/cm$^2$.

Fume extraction should be used as small electrochemical breakdown of the thiocyanate anion occurs with liberation of $H_2S$. Other breakdown products may occur, so normal precautions should be taken.

The pH of the plating bath must be continually monitored and controlled in the range 2.3–2.7.

Because of low total chromium(III) concentration, periodic top-up is required. This is achieved by adding quantities of the concentrate described below on an Amp hour basis.

Preparation of the concentrate is achieved by dissolving 50 grams boric acid in 1 liter of water, adjusting the pH to 2.5, and adding 331 grams $Cr_2(SO_4)_3.15H_2O$ and 324 grams sodium thiocyanate. Heat to dissolve and maintain at 85° C.±5° C. for ninety minutes. Cool; adjust the pH to 2.5. Because of the high concentration of salts; it may be necessary to heat the concentrate to ensure that all salts dissolve.

Add 13 mls. of this concentrate to the plating bath for each Amp hour utilization.

EXAMPLE XV

A concentrate according to the invention was prepared as follows: 33.9 grams of chromium chloride ($CrCl_3.6H_2O$), 20.1 grams sodium thiocyanate (NaNCS), 14.6 grams of sodium chloride (NaCl), and 15 grams of boric acid ($H_3BO_3$) were dissolved in 200 ml of water. The pH was raised to 2.5 with the addition of dilute sodium hydroxide solution and equilibrated at 80° C. for two hours. The volume of the concentrate was adjusted to 250 ml, giving 0.5 M chromium, 1.0 M thiocyanate and 2.5 M chloride.

A plating solution according to the invention was prepared by dissolving 20 grams of boric acid and 20 grams of sodium chloride in 300 ml water and adding 20 ml of the concentrate. 1 g/liter sodium lauryl sulphate was added and the pH adjusted to 2.5 by the addition of dilute hydrochloric acid. This solution was 0.033 M chromium and 0.067 M thiocyanate.

A Hull cell panel was plated as described in Example I from this solution at 3 A for five minutes. Bright chromium was deposited over the range 3 mA/cm$^2$ to 200 mA/cm$^2$.

A convenient way of marketing a plating solution according to the present invention is to provide a concentrate of the chromium(III) chlorothiocyanate or sulphatothiocyanate complexes. The concentrate can be diluted by the user to give the required concentration of the various ions.

While the invention has been particularly shown and described with reference to preferred embodiments thereof, it will be understood by those skilled in the art that various changes in form and details may be made therein without departing from the spirit and scope of the invention.

What is claimed is:

1. An electroplating solution consisting essentially of an aqueous, time and temperature equilibrated solution of buffered chromium(III) thiocyanate complexes having at least one ligand other than thiocyanate or water selected from the group $Cl^{-1}$, $Br^{-1}$, $SO_4^{-2}$, $PO_4^{-3}$, and $NO_3^{-1}$ in the chromium(III) inner coordination sphere, said equilibration being equivalent to that which is achieved by heating the solution for about one hour at 80° C., and the solution concentration of chromium-to-thiocyanate being in the molar ratio of from 1-to-2 to 1-to-6.

2. A solution as claimed in claim 1 in which the complex is said chromium(III) thiocyanate complex having the general formula:

$$((H_2O)_xCR^{III}L_y(NCS)_z)$$

where x is zero or a positive integer and y and z are each positive integers, the sum of x, y and z not exceeding six; and where L is a ligand other than thiocyanate or water.

3. A solution as claimed in claim 2 in which the chromium(III) thiocyanate complex is a chromium(III) thiocyanate complex having the general formula:

$$((H_2O)_{6-m-n}Cr^{III}Cl_m(NCS)_n)^{3-m-n}$$

where m and n are each positive integers and where the sum of m+n does not exceed six.

4. A solution as claimed in claim 2 in which the mixed chromium(III) thiocyanate complexes have the general formula:

$$((H_2O)_{6-2m-n}Cr^{III}(SO_4)_m(NCS)_n)^{3-2m-n}$$

where m is 1 or 2 and n is an integer of at least 1, and where 2m+n does not exceed six.

5. A solution as claimed in claim 1 in which the solution includes a member of the group sodium chloride and potassium chloride.

6. A solution as claimed in claim 1 in which the complex is chromium salt in equilibrium with a thiocyanate salt selected from the group sodium and potassium thiocyanate.

7. A solution as claimed in claim 6 in which the chromium salt is selected from the group chromium chloride ($CrCl_3.6H_2O$), chromium bromide ($CrBr_3.6H_2O$) and chromium sulphate ($Cr_2(SO_4)_3.15H_2O$).

8. A solution as claimed in claim 1 in which the complex is formed by equilibrating a chromium thiocyanate salt with a salt selected from the group sodium and potassium salts of anions.

9. A solution as claimed in claim 1 in which the pH is in the range 4.0 to 2.0.

10. A solution as claimed in claim 1 which includes boric acid in saturation concentration.

11. A solution as claimed in claim 1 further characterized by a source of nickel comprising nickel sulphate ($NiSO_4.6H_2O$) whereby to plate chromium nickel alloy.

12. A solution as claimed in claim 1 further characterized by a source of cobalt comprising cobalt sulphate ($CoSO_4.7H_2O$) whereby to plate a chromium-cobalt alloy.

13. A process of plating chromium or a chromium containing alloy comprising passing an electroplating current between an anode and a cathode in a plating solution consisting essentially of, an essentially aqueous equilibrated solution of buffered chromium(III) thiocyanate complexes having at least one ligand other than thiocyanate or water selected from the group $Cl^{-1}$, $Br^{-1}$, $SO_4^{-2}$, $PO_4^{-3}$ and $NO_3^{-1}$ in the chromium(III) inner coordination sphere in effective concentration for electroplating of chromium, the solution concentration of chromium-to-thiocyanate being in the molar ratio of from 1-to-2 to 1-to-6, and the equilibration of said solution being equivalent to that achieved by heating said solution for about one hour at 80° C.

14. The process of claim 13 wherein the chromium-(III) complex has the formula:

$$(H_2O)_xCr^{III}L_y(NCS)_2$$

where x is zero or a positive integer and y and z are each positive integers, and where the sum of x, y and z does not exceed six; and where L is the ligand other than water or thiocyanate.

15. The process of claim 14 wherein the chromium-(III) complex has the formula:

$$((H_2O)_{6-m-n}Cr^{III}Cl_m(NCS)_n)^{3-m-n}$$

where m and n are each positive integers and where the sum of m+n does not exceed six.

16. The process of claim 14 wherein the chromium-(III) complex has the formula:

$$((H_2O)_{6-2m-n}Cr^{III}(SO_4)_m(NCS)_n)^{3-2m-n}$$

where m is 1 or 2 and n is an integer of at least 1 and where 2m+n does not exceed six.

17. A method of preparing a chromium plating solution comprising equilibrating in an essentially aqueous, buffered solution, a chromium(III) salt selected from the groups of chloride, bromide, sulfate, phosphate and nitrate, and a thiocyanate salt selected from the group of sodium and potassium thiocyanate, the solution concentration of chromium(III)-to-thiocyanate being in the molar ratio of from 1-to-2 to 1-to-6, and the equilibrating of said solution being equivalent to that achieved by heating the solution for about one hour and at a temperature of 80° C. such that said equilibrated plating solution consists essentially of chromium(III) thiocyanate complexes.

18. A method of preparing a chromium plating solution comprising equilibrating in an essentially aqueous buffered solution, a chromium(III) thiocyanate salt with a salt selected from the group sodium and potassium salts of an anion selected from the group of $Cl^{-1}$, $Br^{-1}$, $SO_4^{-2}$, $PO_4^{-3}$ and $NO_3^{-1}$, the solution's chromium-(III)-to-thiocyanate concentrations being in the molar ratio of from 1-to-2 to 1-to-6, and the solution's equilibration being equivalent to that which is achieved by heating the solution for about one hour at 80° C., such that the resulting equilibrated solution consists essentially of the chromium(III) thiocyanate complexes.

* * * * *